United States Patent [19]

Kurihara et al.

[11] 4,143,977

[45] Mar. 13, 1979

[54] PRINT STATION APPARATUS

[76] Inventors: Tohio Kurihara, No. 2-13 Kotobuki-cho, Tokorozawa-shi, Saitama-ken; Nagao Mizutani, No. 1376-46, Sandahigashi-cho, Hachioji-shi, Tokyo; Yasuo Okawara, No. 5-80-205, 3-chome, Hibarigaoka, Hoya-shi, Tokyo; Masamitsu Nojima, 1046, Ina, Itsukaichi-cho, Nishitama-gun, Tokyo; Masao Kunita, No. 335, Higashimitsugi, Sayama-shi, Saitama-ken, all of Japan

[21] Appl. No.: 601,434

[22] Filed: Aug. 4, 1975

[30] Foreign Application Priority Data

| | | | |
|---|---|---|---|
| Aug. 7, 1975 | [JP] | Japan | 49-90637 |
| Aug. 19, 1975 | [JP] | Japan | 49-94857 |
| Aug. 19, 1975 | [JP] | Japan | 49-94858 |
| Aug. 19, 1975 | [JP] | Japan | 49-94859 |

[51] Int. Cl.[2] ..... B41J 11/20

[52] U.S. Cl. ..... 400/56; 400/58; 400/124; 101/93.02

[58] Field of Search ..... 197/144–199, 197/1 R, 129; 101/93.00, 93.02, 287, 269; 400/55–60

[56] References Cited

U.S. PATENT DOCUMENTS

| | | | |
|---|---|---|---|
| 356,406 | 1/1887 | Hey et al. | 101/234 |
| 1,131,997 | 3/1915 | Cooper | 197/129 |
| 1,556,215 | 10/1925 | Girton | 197/146 |
| 2,625,100 | 1/1953 | Williams et al. | 101/93.02 |
| 3,538,848 | 11/1970 | Barbour | 101/269 |
| 3,837,461 | 9/1974 | Waibel | 197/148 |
| 3,912,068 | 10/1975 | Kwan et al. | 197/149 |
| 4,029,193 | 6/1977 | Kwan | 197/149 |

FOREIGN PATENT DOCUMENTS

| | | | |
|---|---|---|---|
| 1224696 | 3/1971 | United Kingdom | 101/93.00 |

OTHER PUBLICATIONS

Delapchier, "Passbook for Disk Printer," IBM Technical Disclosure Bulletin, vol. 13, No. 8, p. 2350, Jan. 1971.

Vichich, "Printing Platen for Nonuniform Thickness Forms", IBM Technical Disclosure Bulletin, vol. 16, No. 2, p. 605, Jul. 1973.

*Primary Examiner*—William Pieprz

*Attorney, Agent, or Firm*—Holman & Stern

[57] ABSTRACT

A platen assembly for a print station apparatus, which comprises first and second indepently movable platen units for holding recording medium so as to compensate for thickness of the medium, a third platen unit interposed between the first and second platen units and independently movable from the first and second platen units, the third platen unit having a minimum length necessary for holding the centerfold of the medium, and first and second springs secured to the first and second platen units and biasing the third platen unit toward a guide of the print station apparatus.

2 Claims, 8 Drawing Figures

PRINT STATION APPARATUS

FIELD OF THE INVENTION

This invention relates in general to a print station apparatus for holding recording media for printing of characters thereon and, more particularly, to an improved print station apparatus capable of holding single or multi-layer recording media including bank passbook type documents having different thickness variations.

BACKGROUND OF THE INVENTION

In conventional print station apparatus, it has heretofore been proposed to provide various devices for spacing recording media relative to a print head for proper printing relationship. Typical of one of these prior expedients is to provide a gap guide means against which the recording media is urged by a platen so that an appropriate gap is provided between the print head and the recording media for proper operations of the print head. In this prior expedient, the platen is arranged to yieldingly urge the recording media against the gap guide means so as to automatically accommodate one or more layers of the recording media. This platen assembly is particularly useful in point-of-sale data terminals where the recording media is usually multiple copy forms of varying numbers for bills of sale, invoices, contracts of sale, and the like. However, problems are encountered with such prior art platen assembly in that it is difficult to correctly position the face of the recording media relative to the print head especially where the recording media is of bank passbook type documents whose thicknesses vary on either side of the centerfold.

To accommodate the thickness variations of the passbook type documents, it has also heretofore been proposed to have a platen body made of elastic or resilient soft material and formed with a plurality of alternating annular grooves and rings disposed longitudinally along the platen body. With this prior art platen body, the passbook type document is pressed by the ring portions formed longitudinally along the platen body so that areas at which the document is not urged by the platen body are provided and, therefore, the platen body can not correctly position the passbook type document relative to the print head. Another problem inherent in this platen body resides in the fact that the document can not properly be printed with uniform qualities due to the difference in forces acting on the passbook type document to support the same. In addition, the plate body is arranged to be pressed onto the passbook type document with relatively larger forces so that the ring portions deflect to accommodate the document thickness variations. This is particularly serious especially where the passbook type document is made of pressure-sensitive papers which may be contaminated with a slight pressure applied thereon. As previously discussed hereinabove, since the platen body has a plurality of annular grooves longitudinally disposed along the platen body, a relatively thin single layer of recording medium can not be printed.

In order to properly hold the bank passbook type document, it has also been proposed to have the print station apparatus equipped with a sensing means to sense the thickness of the document and a print head driving mechanism such as a servo motor or a pulse motor which is controlled in response to electric signals indicative of the thickness of the document to move the print head relative to the document. With this expedient, the print station apparatus becomes necessarily complex in construction and, therefore, the manufacturing cost increases.

A further problem encountered in the prior art printers is that it is difficult to form clear imprints of uniform density and, further, the print head is not smoothly traversed over the recording media especially in a case where the recording media is of the passbook type document in which the thickness to either side of the centerfold varies.

OBJECTS AND SUMMARY OF THE INVENTION

It is, therefore, an object of the present invention to provide an improved print station apparatus which overcomes the shortcomings encountered in the prior art devices.

It is another object of the present invention to provide a print station apparatus suited for holding bank passbook type documents so as to accommodate the thickness variations thereof yet providing ease of holding single or multi-layer recording media such as bills of sale, invoices, contracts of sale, and the like for proper printing operations.

It is a further object of the present invention to provide a print station apparatus arranged to hold various kinds of recording media properly for providing clear imprints of uniform quality.

It is a still further object of the present invention to provide a print station apparatus which is simple in construction, highly reliable in operation, and easy to manufacture to reduce manufacturing costs.

In order to achieve these objects, the present invention contemplates to provide a print station apparatus including a guide means for spacing recording media relative to the print head so that a predetermined amount of gap is provided between the print head and the recording media for proper operation of the print head, and a platen means to urge the recording media against the guide means. The platen means comprises a plurality of separate platen units disposed longitudinally along the print line and engage with the recording media at different points to accommodate the thickness variations of the recording media.

These and other objects, features and advantages of the present invention will become more apparent from the following description when taken in conjunction with the accompanying drawings, in which:

DESCRIPTION OF PREFERRED EMBODIMENTS

Although the print station apparatus of the present invention is suited for holding various kinds of recording media including single or multi-layer recording media and bank passbook type documents for printing characters thereon, the present invention is illustrated and described herein as employing a bank passbook type document for the sake of explanation only. Also, it is to be noted while the present invention is shown and described herein as applied to a matrix type printer, the present invention is not limited thereto and has many applications in other types of printers.

Figure 1:
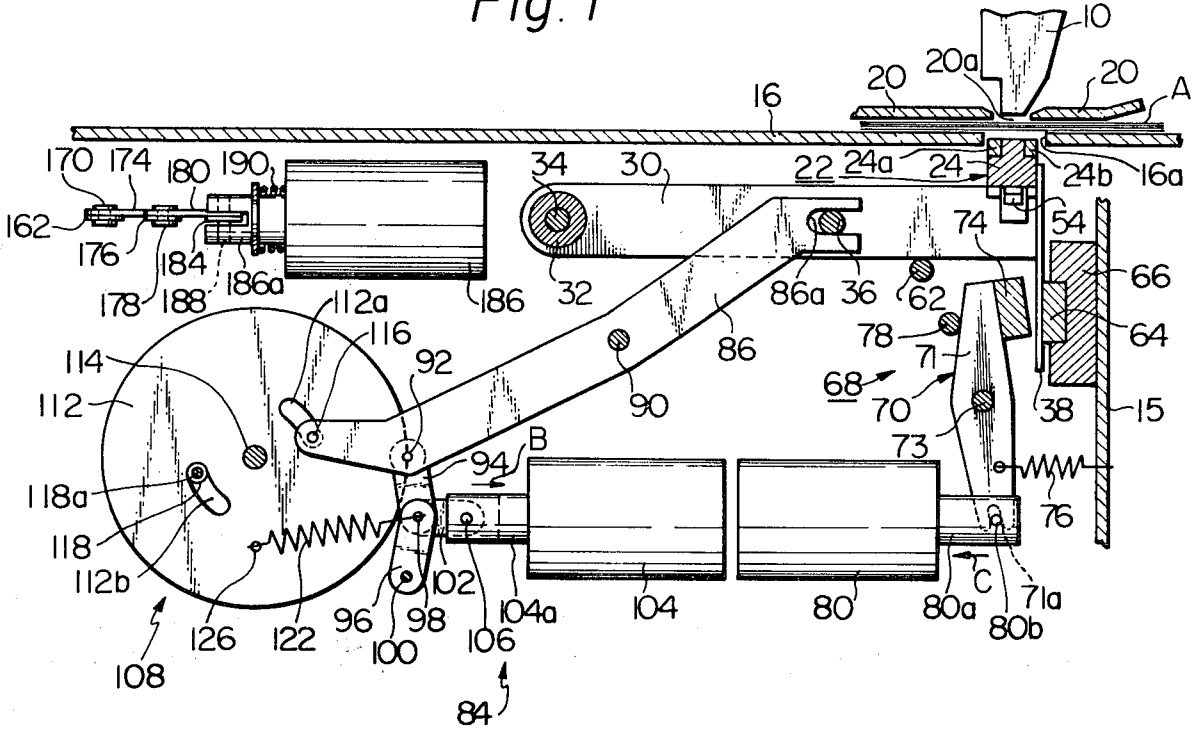
FIG. 1 is a schematic fragmentary front view of a preferred embodiment of a print station apparatus according to the present invention, and showing a platen means in its normal or inoperative position.
Figure 2:
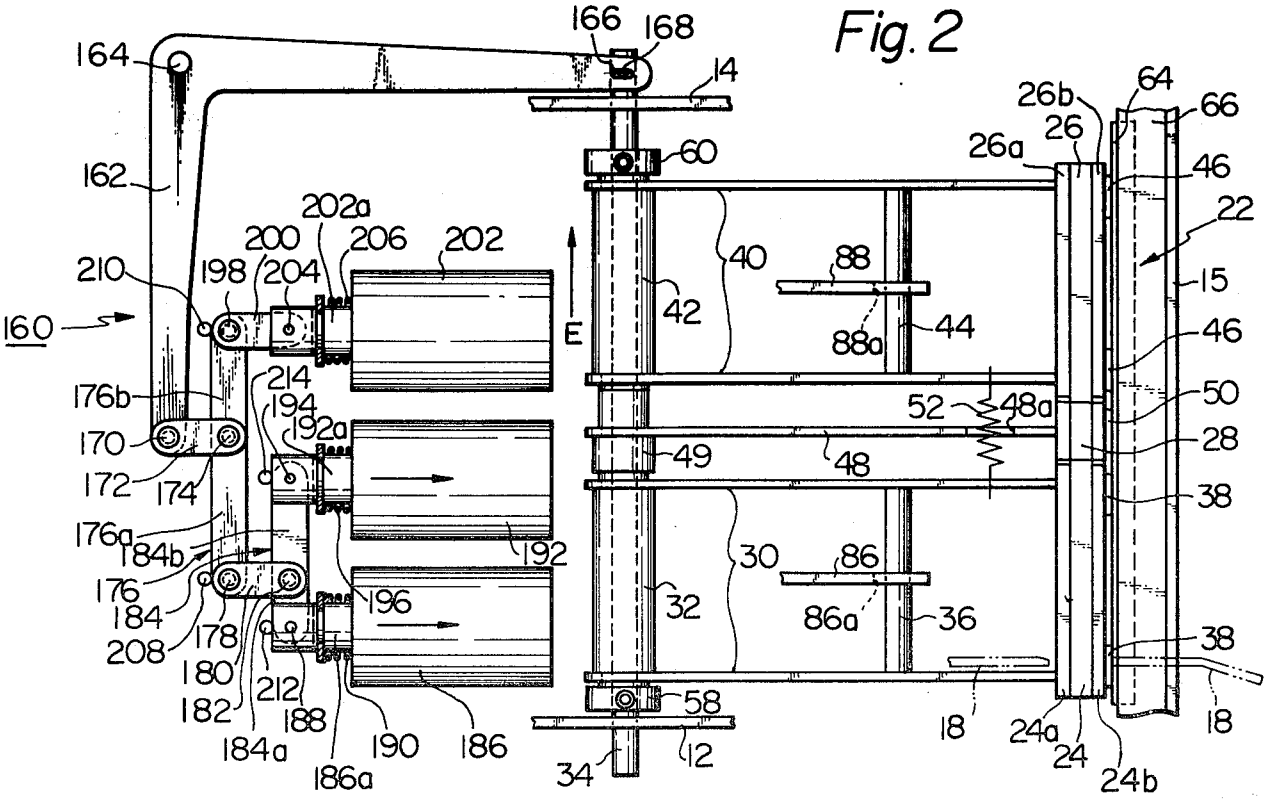
FIG. 2 is a schematic plan view of position selector means forming part of the apparatus shown in FIG. 1.
Figure 3:
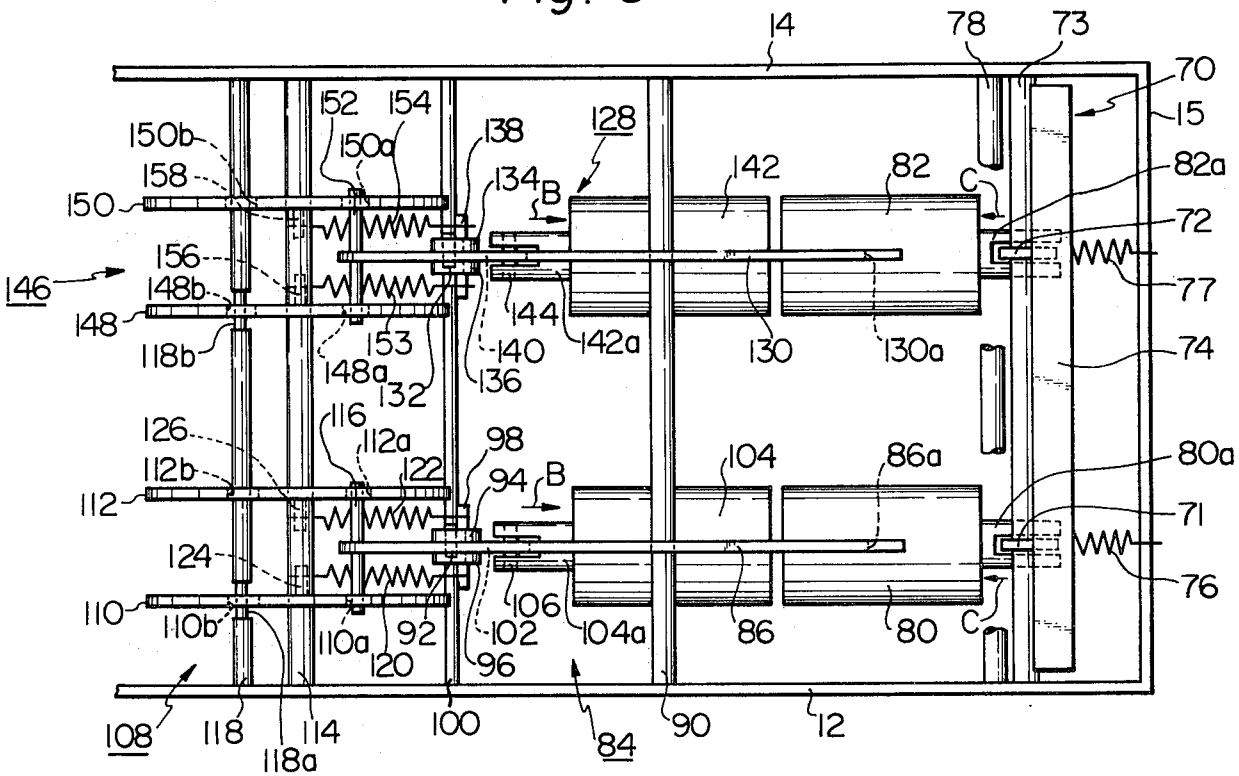
FIG. 3 is a schematic plan view showing actuating means forming part of the apparatus shown in FIG. 1.

Referring now to FIGS. 1 to 3 of the drawings, a print station apparatus is shown as being applied to a matrix type printer having a print head 10. The print head 10 is, as customary, supported by a carriage (not shown) which is movable on a guide rail (not shown) in a direction parallel to a print line. The apparatus comprises a base plate (not shown) to which is secured side frames 12 and 14 as shown in FIG. 2. A front frame 15 is also secured to the base plate as shown in FIG. 1.

A passbook support plate 16 is supported between the side frames 12 and 14. The support plate 16 has an elongated recess 16*a* extending in parallel to the print line to provide a spacing through which a platen means is freely movable. A guide block 18 is rigidly attached to the left end of the support plate 16 and serves to guide the side edge of a bank passbook type document A (see FIG. 5). A gap guide means in the form of a plate 20 is also supported between the side frames 12 and 14 above the support plate 16 and has an elongated print opening 20*a* formed therein which is aligned with the elongated recess 16*a* of the support plate 16. The guide means 20 provides an appropriate gap between the matrix print head 10 and the document A to position the document A for proper thrust of the matrix wires and clearance of the head for movement thereof. At the appropriate time, the platen means is moved from its normal or inoperative position to its upper or print position urging the document A against the guide means 20. Thus, the document A is held by the guide means 20 and the platen means at an appropriate position during printing operations, and the matrix print head 10 is capable of freely traversing the document during the printing operations because of the appropriate gap determined exactly by the gap guide means 20.

In accordance with an important feature of the present invention, the platen means which is generally designated as 22 is comprised of a plurality of separate platen units 24, 26 and 28 which are longitudinally disposed along the printing line. The platen units 24, 26 and 28 are arranged to urge the bank passbook type documents against the gap guide means 20 at different appropriate positions to accommodate the variations in the passbook document thickness during the printing operations.

As best shown in FIG. 2, the platen unit 24 is rigidly fixed to one ends of a pair of actuating arms 30, the other ends of which are attached to a boss member 32. The actuating arms 30 extend in a direction perpendicular to the printing line. The boss member 32 is rotatably mounted on a slidable shaft 34 rotatably supported between the side frames 12 and 14, the shaft 34 forming part of a position selector means for transversely moving the platen means 22 along the print line relative to the guide block 18 in a manner as will be subsequently discussed in detail. Thus, the actuating arms 30 are rotatable about the shaft 34 clockwise or counter-clockwise to move the platen unit 24 to its normal or printing position. A connecting rod 36 transversely extends between the pair of actuating arms 30 and is connected thereto. As shown in FIGS. 1 and 2, the platen unit 24 is provided on both sides thereof with resilient members 24*a* and 24*b* made of resilient deformable material such as rubber and having respective upper surfaces on the same plane as the bearing surface of the platen unit 24 whereby when the platen unit 24 is caused to impinge upon the document A, the impact force of the unit 24 is alleviated and undesirable contamination of the document is satisfactorily prevented. In order to fixedly hold the platen unit 24 in place during the printing operation, a pair of clamping plates 38 are fixedly attached to one face of the platen unit 24 and adapted to be clamped in a manner which will be subsequently described in detail.

Likewise, the platen unit 26 is rigidly fixed to one ends of a pair of actuating arms 40, the other ends of which are attached to a boss member 42 rotatably mounted on the slidable shaft 34. The actuating arms 40 extends perpendicular to the print line and are rotatable about the slidable shaft 34 clockwise or counter-clockwise to move the platen unit 26 to its normal or print position. A connecting rod 44 transversely extends between the pair of actuating arms 40 and is connected therewith. The platen unit 26 is provided on both sides thereof with resilient members 26*a* and 26*b* made of resilient deformable material such as rubber and having respective upper surfaces on the same plane as the bearing surface of the platen unit 26 to alleviate the impact force of the unit 26 when it impinges upon the document A for thereby preventing the contamination of the document. In order to fixedly hold the platen unit 26 in place during the printing operation, a pair of clamping plates 46 are connected to one face of the platen unit 26 and adapted to be clamped in a manner which will be described in detail hereinafter.

Figure 4:
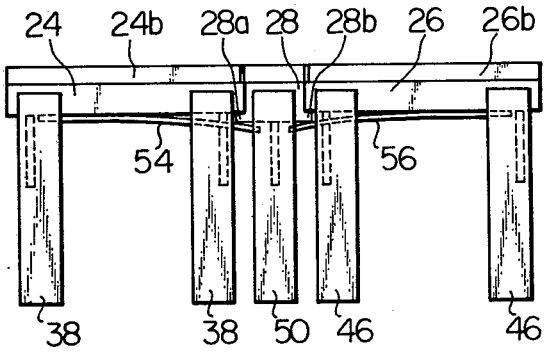
FIG. 4 is a schematic right-hand side view of the apparatus shown in FIG. 1.
Figure 5:
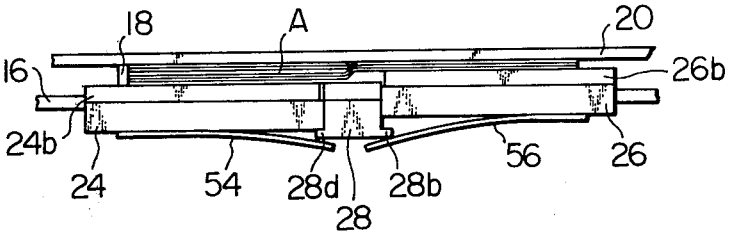
FIG. 5 is a schematic view illustrating how the platen means forming part of the apparatus urges the recording media having different thickness variations against the guide means.

The platen unit 28 is carried at one end of an actuating arm 48, the other end of which is fixed to a boss member 49 rotatably mounted on the slidable shaft 34. The platen unit 28 is arranged to urge the document A at a position near its centerfold against the gap guide means 20. As best shown in FIGS. 4 and 5, the platen unit 28 is formed with laterally extending shoulders 28*a* and 28*b* which is engageable with either one of or both of the platen units 24 and 26. In order to biase the platen unit 28 toward the printing position, suitable biasing means such as leaf springs 54 and 56 are secured to the bottom walls of the platen units 24 and 26, respectively. It should be noted that the shoulders 28*a* and 28*b* are so arranged as to align the upper surface of the platen unit 28 with those of the platen units 24 and 26 when the shoulders 28*a* and 28*b* abut against the bottom walls of the platen units 24 and 26 as shown in FIG. 4. A clamping plate 50 is fixed to one face of the platen unit 28 and adapted to be clamped during the printing operation in a manner as will be subsequently described. Indicated as 52 is a biasing means such as a tension spring which extends through a bore 48*a* of the actuating arm 48 and is connected between the actuating arms 30 and 40 to urge the platen units 24 and 26 inward in the direction of print line so that the platen units 24 and 26 are urged toward each other. It should be noted that the widths of the platen units 24, 26 and 28 are preferably designed to be minimum so that an area in which the printing is difficult to achieve is reduced as small as possible near the centerfold of the document in which the thickness to either side of the centerfold varies in a direction perpendicular to the print line.

As previously described, the actuating arms 30, 40 and 50 are rotatably mounted on the slidable shaft 34 so that the platen means 22 is moved to its inoperative or print position. Designated by reference numeral 58 is a collar which is fixedly mounted on the slidable shaft 34, to which a second collar 60 is also connected to cause the actuating arms 30, 40 and 48 to be movable with the slidable shaft. To prevent excessive downward movements of the actuating arms 30, 40 and 48 a platen stopper in the form of a rod 62 is provided which is supported between the side frames 12 and 14. Thus,, the actuating arms 30, 40 and 48 abut against the platen stopper 62 to maintain the platen means 22 in its normal or inoperative position. Indicated as 64 is a transversely extending brake shoe or friction element made of a material having a larger coefficient of friction which is carried by a backing plate 66 extending transversely in a direction parallel to the printing line and secured to one face of the front frame 15. The clamping element 66 forms part of the clamping means for clamping the clamping plates 38, 46 and 50.

As shown in FIGS. 1 and 3, the clamping means, which is generally designated by reference numeral 68, comprises a clamping lever assembly 70 having a pair of levers 71 and 72 which are rotatably supported by a pivot shaft 73 extending transversely between the side frames 12 and 14. The clamping lever assembly 70 carries at its upper end a second transversely extending brake shoe or friction element 74 which is engageable with adjacent face of the clamping plate 38. The clamping lever assembly 70 is urged at its lower portion in a counter-clockwise direction by means of a pair of tension springs 76 and 77. The tension spring 76 is connected between the lower part of the lever 71 and the front frame 15, while the tension spring 77 is connected between the lower part of the lever 72 and the front frame 15. A rod 78 extends between the side frames 12 and 14 and serves as a stop for the clamping lever assembly 70. To actuate the clamping means 68, a drive force is electromagnetically provided by a pair of solenoids 80 and 82 which are energized or de-energized manually or in response to electrical command signals. The solenoid 80 has a movable plunger **80*a* provided with an engaging pin 80*b* which engages with a slot 71*a* formed at the lower end of the lever 71. The solenoid 80 is mounted on the base plate (not shown) and serves to rotate the lever assembly 70 clockwise about the pivot shaft 73. Similarly, the solenoid 82 has a movable plunger 82*a* provided with an engaging pin 82*b* which engages with a slot (not shown) formed at the lower end of the lever 72. The solenoid 82 is mounted on the base plate and cooperates with the solenoid 80 to rotate the lever assembly 70 clockwise about the pivot shaft 73 against the forces of the tension springs 76 and 77. With this arrangement, if the solenoids 80 and 82 are de-energized, the lever assembly 70 is held in a position shown in FIG. 1 by the actions of the tension springs 76 and 77 so that the clamping means 68 is held in its disengaged condition. If, however, the solenoids 80 and 82 are energized, the plungers 80*a* and 82*a* are caused to retract so that the lever assembly 70 are rotated clockwise to engage the clamping means 68 by which the clamping plate 38** is fixedly held during the printing operations.

The platen unit 24 forming part of the platen means 72 is moved to its operative or inoperative position by an actuating means 84. As best shown in FIGS. 1 and 3, the actuating means 84 comprises a bell crank 86 pivotally supported on a shaft 90 which is supported between the side frames 12 and 14. The bell crank 86 is formed at its upper end with a slot **86*a* with which the connecting rod 36 of the first platen unit 24 engages. The bell crank 86 is provided at its lower portion with a pivot stud 92, to which a first toggle plate 94 is pivotally connected at its one end. The first toggle plate 94 is connected at its other end to one end of a second toggle plate 96 by a pivot pin 98. The second toggle plate 96 is pivotally supported at its other end by an elongated shaft 100 extending between the side frames 12 and 14. The toggle plates 94 and 96 are connected through a connecting rod 102 to a plunger 104*a* of a first solenoid 104 by means of the pivot pin 98 and a pin 106 provided at a leading end of the plunger 104*a* and actuated by the first solenoid 104. The solenoid 104 may be energized by manually controlling a switch in an electrical circuit (not shown) or in response to an electrical command signal generated by a control unit (not shown). In this instance, the bell crank 86 is rotated counter-clockwise and, accordingly, the actuating arms 30 are also rotated counterclockwise thereby moving the platen unit 24 to its print portion for urging the document A against the gap guide means 20. Thereafter, the solenoid 80 is energized so that the plunger 80*a* is retracted thereby rotating the lever 71 clockwise by which the clamping plates 38, 50 and 46 are clamped. When the printing operation is completed, the solenoid 104 is de-energized so that the plunger 104*a* protrudes thereby pushing the connecting portion of the toggle plates 94 and 96. Thus, when the solenoid 80 is de-energized the bell crank 86 is rotated clockwise and, therefore, the platen unit 24** is moved to its normal or inoperative position.

Indicated as 108 is a means for controlling the flying speed of the platen unit 24. The flying speed control means 108 comprises a pair of inertia members of flywheels 110 and 112 which are rotatably supported on a shaft 114 extending between the side frames 12 and 14. The inertia member 110 is provided with elongated slots **110*a* and 110*b* formed in symmetrical relationship with respect to the axis of the shaft 114. Likewise, the inertia member 112 is provided with elongated slots 112*a* and 112*b* formed in symmetrical relationship with respect to the axis of the shaft 114. An engaging pin 116 mounted at the lower end of the bell crank 86 is inserted through the elongated slots 110*a* and 112*a* of the inertia members 110 and 112, respectively. A stopper in the form of a rod 118 extends through the elongated slots 110*b* and 112*b* of the inertia members 110 and 112, respectively, and is supported between the side frames 12 and 14. The stopper 118 has first and second reduced diameter portions 118*a* and 118*b*. The reduced diameter portion 118*a* of the stopper 118 is inserted through the elongated slot 110*b* of the inertia member 110. In order to urge the inertia members 110 and 112 in a counter-clockwise direction as viewed in in FIG. 1, a pair of urging means such as tension springs 120 and 122 are provided which serve to urge the platen unit 24 toward its inoperative or normal position. The tension spring 120 is connected at its one end to the inertia member 110 by means of a pin 124 and connected at its other end of the pivot pin 98 interconnecting the first and second toggle plates 94 and 96. Similarly, the tension spring 112 is connected at its one end to the inertia member 112 by means of a pin 126 and connected at its other end to the pivot pin 98. With this arrangement, the tension springs 120 and 122 urges the inertia members 110 and 112 in the counter-clockwise direction so that the inertia members 110 and 112 are held in their normal or initial positions by the action of the stopper 118. It is to be noted in this instance that, since the reduced diameter portion 118***a* of the stopper 118 engages with the elongated slot 110*b* of the inertia member 110 while the larger diameter portion of the stopper 118 engages with the elongated slot 112*a* of the inertia member 112, the inertia members 110 and 112 are angularly displaced from each other by an amount corresponding to the difference in diameter of the larger diameter portion and the reduced diameter portion. Thus, when the bell crank 86 is rotated counter-clockwise as viewed in FIG. 1, the engaging pin 116 mounted at the lower end of the bell crank 86 initially rotates the inertia member 110 clockwise against the force of the tension spring 120 and, after the inertia member 110 has been rotated clockwise at a given angle, the engaging pin 116 engages with the elongated slot 112*a* of the inertia member 112 for thereby rotating the inertia member 112 against the force of the tension spring 122. Thus, the flying speed of the platen unit 24 is satisfactorily reduced in several steps in a manner which will be more clearly described hereinafter.

Similarly, the platen unit 26 is moved to its operative or inoperative positions by an actuating means 128. As best shown in FIG. 3, the actuating means 128 comprises a bell crank 130 which is similar in construction to the bell crank 86 of the platen unit 24. The bell crank 130 is pivotally supported on the shaft 90 and formed at its upper end with a slot 130*a* with which the connecting rod 44 of the second platen unit 26 engages. The bell crank 130 is provided at its lower portion with a pivot stud 132, to which a first toggle plate 134 is pivotally connected at its one end. The first toggle plate 134 is connected at its other end to one end of a second toggle plate 136 by a pivot pin 138. The second toggle plate 136 is pivotally supported at its other end by the elongated shaft 100. The first and second toggle plates 136 and 138 are connected through a connecting rod 140 to a plunger 142*a* of a second solenoid 142 by means of the pivot pin 138 and a pin 144 provided at a leading end of the plunger 142*a* and electromagnetically controlled. The solenoid 142 may be energized by manually controlling a switch in an electrical circuit (not shown) or in response to an electrical command signal generated by a suitable means (not shown). During printing operation, the solenoid 142 is energized so that the plunger 142*a* retracts thereby pulling the connecting rod 140 rightward as viewed in FIG. 3. In this instance, the bell crank 130 is rotated about the shaft 90 and, therefore, the actuating arms 40 of the second platen unit 26 is rotated about the shaft 34 in the same direction as the bell crank 130 so that the second platen unit 26 is moved from its inoperative position to its print or operative position. When the printing operation is completed, the solenoid 142 is de-energized so that the plunger 142*a* protrudes thereby pushing the connecting portion of the first and second toggle plates 136 and 138 and, accordingly, the bell crank 130 is rotated in a direction to move the second platen unit 26 to its inoperative or normal position.

Indicated as 146 is a means for controlling the flying speed of the second platen unit 26. The flying speed control means 146 comprises a pair of inertia members or fly-wheels 148 and 150. The inertia members 148 and 150 are rotatably supported on the shaft 114 on which the inertia members 110 and 112 of the flying speed control means 108 are also rotatably supported. The inertia member 148 is provided with elongated slots 148*a* and 148*b* formed in symmetrical relationship with respect to the axis of the shaft 114. Likewise, the inertia member 150 is provided with elongated slots 150*a* and 150*b* formed in symmetrical relationship with respect to the axis of the shaft 114. An engaging pin 152 is connected at the lower end of the bell crank 130 and inserted through the elongated slots 148*a* and 150*a* of the inertia members 148 and 150, respectively. The stopper 118 extends through the elongated slots 148*b* and 150*b* of the inertia members 148 and 150. The reduced diameter portion 118*b* of the stopper 118 is inserted through the elongated slot 148*b* of the inertia member 148 while the larger diameter portion is inserted through the elongated slot 150*b* of the inertia member 150. A pair of urging means such as tension springs 153 and 154 are provided for urging the inertia members 148 and 150 in one direction for thereby urging the platen unit 26 toward its normal or inoperative position. The tension spring 153 is connected at its one end to the inertia member 148 by means of a pin 156 and connected at its other end to the pivot pin 138 interconnecting the first and second toggle plates 134 and 136. Similarly, the tension spring 154 is connected at its one end to the inertia member 150 by means of a pin 158 and connected at its other end to the pivot pin 138. The flying speed control means 146 operates in a manner similar to that of the flying speed control means 108 and, therefore, the detail description of the same is herein omitted for the sake of simplicity of description.

Turning now to FIG. 2, a position selector means 160 is connected to the slidable shaft 34 for transversely moving the slidable shaft 34 in the direction parallel to the print line thereby to position the platen means 22 at selected positions whereby the intermediate or third platen unit 50 is located near the centerfold of the bank passbook type document. The position selector means 160 comprises a bell crank lever 162 pivotally mounted on a pivot shaft 164 supported by a suitable structural part (not shown) of the print station apparatus. The bell crank lever 162 is formed at its one end with an elongated slot 166 with which a pin 168 fixed to one end of the slidable shaft 34 engages so that the slidable shaft 34 is moved by the bell crank lever 162. Other end of the bell crank lever 162 is provided with a stud 170, to which one end of a connecting rod 172 is pivotally connected. The connecting rod 172 is connected at its other end to a lever arm 176 through a pin 174 connected thereto such that the length ratio of the arm portions 176*b* and 176*a* is, for example, 3:4. The arm portion 176*a* is provided with a pin 178 to which a connecting rod 180 is pivotally connected at its one end. The connecting rod 180 is connected at its other end to a second lever arm 184 by means of a pin 182 connected thereto such that the length ratio of arm portions 184*a* and 184*b* is, for example, 1:2. The arm portion 184*a* is connected at its one end to a plunger 186*a* of a first solenoid 186 by means of a pin 188 and is electromagnetically controlled. A compression spring 190 is provided for normally urging the plunger 186a outward from the solenoid 186. The arm portion 184b is connected at its one end to a plunger 192a of a second solenoid 192 by means of a pin 194 and is electromagnetically controlled. The solenoid 192 has a compression spring 196 which normally urged the plunger 192a outward. The arm portion 176b of the first lever arm 176 is provided at its one end with a pin 198 to which one end of a connecting rod 200 is pivotally connected. The connecting rod 200 is connected at its other end to a plunger 202a of a third solenoid 202 by means of a pin 204 and is electromagnetically controlled. The third solenoid 202 has a compression spring 206 which normally urges the plunger 202a outward. A stopper 208 is fixedly connected to the structural part (not shown) of the print station apparatus and normally abuts against the one end of the arm portion 176a. Thus, the stopper serves as a positioning member for the end of the arm portion 176a. Likewise, a stopper 210 is provided for normally engaging with the one end of the arm portion 176b and serves as a positioning member for the end of the arm portion 176b. A stopper 212 is also provided for normally engaging with the one end of the arm portion 184a and serves as a positioning member for the end of the arm portion 184a. Likewise, a stopper 214 is provided for normally engaging with the one end of the arm portion 184b and serves as a positioning member for the arm portion 184b. It should be noted that a control signal generating circuit for generating control signals applied to the solenoids 186, 192 and 202 does not constitute an essential part of the present invention and, therefore, a detailed description of the same is herein omitted.

In operation, recording media such as a bank passbook type document A is first opened to the proper page and placed between the passbook support plate 16 and the guide plate 20. The passbook type document A is then manually pushed to a point where the leading edge abuts against the guide block 18 as shown in FIG. 5. If the passbook type document A has the centerfold extending perpendicular to the print line and the thickness to each side of the centerfold are different from each other, it is desirable to locate the third platen unit 28 near the centerfold of the document A so that the first and second platen units 24 and 26 engage with appropriate portions of the document A whereby the opened pages or the recording surfaces are equally spaced from the print head 10. In this respect, assuming that it is necessary to move the platen means 22 by an amount of 3/7 the whole amount of travel of the platen means 22 in the direction of the print line relative to the guide block 18, the first and second solenoids 186 and 192 are energized by a first command signal received from a suitable means such as a keyboard (not shown) of the print station apparatus with the third solenoid 202 kept in its de-energized condition. In this situation, the plungers 186a and 192a of the first and second solenoids 186 and 192 are caused to retract against the forces of the compression springs 190 and 196 thereby pulling the lever arm 184 rightward as viewed in FIG. 2. Rightward movement of the lever arm 184 is transmitted through the connecting rod 180 to the lever arm 176 so that the lever arm 176 is rotated counter-clockwise about the pin 198. At this instant, the bell crank 162 of the position selector means 160 is rotated counter-clockwise about the pivot pin 164 at degrees corresponding to 3/7 the whole rotational angle of the bell crank 162. Since, in this instance, the bell crank 162 is connected to the slidable shaft 34 by the pin 168 engaging with the slot 166, the slidable shaft 34 and accordingly the platen means 22 connected thereto by the actuating arms 30, 40 and 48 are moved in a direction of arrow E in FIG. 2 by an amount equal to 3/7 the whole amount of travel of the platen means 22. Thus, the third platen unit 28 is moved to a point near the centerfold of the document A as shown in FIG. 5. Similarly, the platen means 22 may be moved to any given point relative to the guide block 18 so that the third platen unit 28 is placed near the centerfold of the document at all times even when the distance between each of the centerfolds of the documents and the guide block 18 significantly varies due to the variations in size. This is attained by energizing or de-energizing selected one of or all of the first, second and third solenoids 186, 192 and 202.

When the document A has been moved to the print position, the solenoids 104 and 142 of the actuating means 84 and 128 are energized by a second command signal generated by a suitable means (not shown). In this condition, the plungers 104a and 142a of the solenoids 104 and 142 retract in a direction shown by arrows B in FIG. 3. The movement of the plunger 104a is transmitted to the connecting rod 102 thereby rotating the second toggle plate 96 clockwise about the pivot shaft 100 as viewed in FIG. 1 against the forces of the tension springs 120 and 122. At the same time, the movement of the plunger 142a is transmitted to the connecting rod 140 thereby rotating the second toggle plate 136 about the pivot shaft 100 against the forces of the tension springs 152 and 154. Rotation of the second toggle plate 96 causes the bell crank 86 to rotate counter-clockwise about the shaft 90 by means of the first toggle plate 94 as viewed in FIG. 1. Concurrently, the second toggle plate 136 of the actuating means 128 rotates the bell crank 130 about the shaft 90 by means of the first toggle plate 134. Since, in this instance, the slot 86a of the bell crank 86 engages with the connecting rod 36, the actuating arms 30 are rotated counter-clockwise about the shaft 34 so that the first platen unit 24 are moved toward the guide means 20. Likewise, the bell crank 88 rotate the actuating arms 40 about the shaft 34 so that the second platen unit 26 is moved toward the guide means 20. Under these circumstances, the actuating arm 48 is also rotated in the same direction as the actuating arms 30 about the shaft 34 by the actions of the leaf springs 54 and 56 (see FIG. 5) and, therefore, the third platen unit 28 is moved toward the guide means 20. In this manner, the first, second and third platen units 24, 26 and 28 are moved to the print position and urge the document A against the guide means 20 at different points as shown in FIG. 5 so that a predetermined amount of gap is provided between the opened pages or recording surfaces of the document A and the print head 10 for the proper operation of the print head 10. It will be appreciated in this instance that since the first and second flying speed control or reducing means 108 and 146 are provided between the bell crank 86 and the first actuating means 84 and between the bell crank 130 and the second actuating means 128, respectively, the flying speed of the first and second platen units 24 and 26 are satisfactorily reduced to alleviate shocks to be applied to the document A. More specifically, when the bell crank 86 is rotated counter-clockwise about the shaft 90, the engaging pin 116 connected to the lower end of the bell crank 86 abuts against the shoulders of the elongated slots 110a and 112a of the first and second inertia members 110 and 112. Thus, after the engaging pin 116 has engaged with the shoulders of the elongated slots 110*a* and 112*a*, the speed of rotation of the bell crank 86 is braked by the action of the first and second inertia members 110 and 112 urged by the actions of the tension springs 120 and 122. Likewise, when the bell crank 130 is rotated about the shaft 90, the engaging pin connected to the lower end of the bell crank 130 abuts against the shoulders of the elongated slots 148*a* and 150*a* of the first and second inertia members 148 and 150. After the engaging pin has abutted against the shoulders of the elongated slots 148*a* and 150*a*, the speed of rotation of the bell crank 88 is reduced by the inertia of the first and second inertia members 148 and 150 and the actions of the tension springs 153 and 154. Thus, the flying speed of the first and second platen units 24 and 26 is satisfactorily reduced so that the shock to be applied to the document by the platen means 22 is alleviated.

Figure 6:
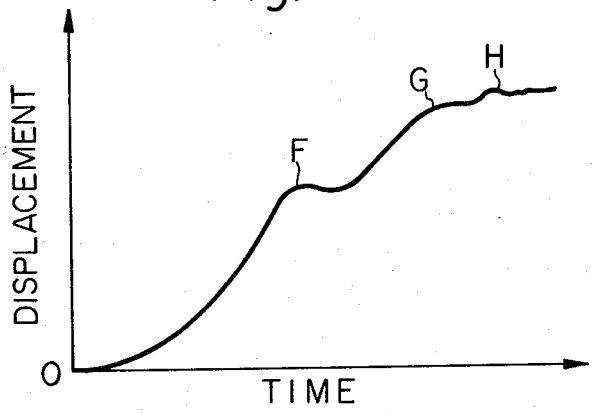
FIG. 6 is a graphical representation of the operation of the actuating arms of the platen means shown in FIG. 2.

FIG. 6 illustrates a graphical representation of the operation of the flying speed reducing means 108 and 146 mentioned hereinabove. In FIG. 6, the ordinate indicates the displacement of the bell crank 86 or the bell crank 130 while the abscissa indicates the variations of time. First, assuming that the solenoid 86 is energized, the bell crank 86 is rotated from a point O corresponding to an inoperative position of the platen means 22 to a point F, at which time the engaging pin 116 engaging with the shoulder of the elongated slot 110*a* tends to rotate the inertia member 110 against the action of the tension spring 120 and, thus, the first reduction of flying speed of the platen means 22 is achieved. During continuous retracting movement of the plunger 104*a* of the solenoid 104, the bell crank 86 is further rotated from the point F to a point G, at which time the engaging pin 116 engaging with the shoulder of the elongated slot 112*a* of the second inertia member 112 tends to rotate the second inertia member 112 against the action of the spring 122 and, thus, the second reduction of flying speed of the platen means 22 is achieved. The bell crank 86 is further rotated to a point H at which time the platen means 22 presses the document A against the guide means 20 and the platen means 22 is held in the print position. Likewise, when the solenoid 142 is energized, the bell crank 130 is rotated from the point O to the point F at which time the engaging pin 152 engaging with the shoulder of the elongated slot 148*a* of the first inertia member 148 tends to rotate the first inertia member 148 against the force of the spring 153 and, thus, the first reaction of flying speed of the platen means 22 is achieved. When the bell crank 130 is further rotated from the point F to the point G at which time the engaging pin 152 engaging with the shoulder of the elongated slot 150*a* of the second inertia member 150 tends to rotate the second inertia member 150 against the force of the spring 154 and, thus, the second reduction of flying speed of the platen means 22 is achieved. The platen means 22 is stopped in its print position when the bell crank 130 is rotated from the point G to the point H at which time the platen means 22 engages with the document A and presses the same against the guide means 20.

FIG. 5 shows the first, second and third platen units 24, 26 and 28 holding the passbook type document A at different points, respectively, so that the recording surface is equally spaced from the print head 10. In FIG. 5, the first platen unit 24 is shown as urging the thick portion of the document against the guide means 20, whereas the second platen unit 26 urges the thin portion of the document against the guide means 20. The third platen unit 28 is biased upward by the actions of the leaf springs 54 and 56 secured to the bottom faces of the first and second platen units 24 and 26, respectively, and urges the centerfold of the document A against the guide means 20. It will be noted that the passbook type document A is satisfactorily placed in a position where the recording surface is equally spaced from the print head 10 for the proper operation of the print head 10 even though the passbook type document A has different thicknesses on each side of the centerfold.

Thus, when the platen means 22 is moved to its print position, the solenoids 80 and 82 are energized by a third command signal generated by suitable means (not shown) and, accordingly, the plungers 80*a* and 82*a* are caused to retract in a direction as shown by arrows C in FIG. 3. Retracting of the plungers 80*a* and 82*a* causes the levers 71 and 72 to rotate clockwise as viewed in FIG. 1 against the forces of the tension springs 76 and 77. Consequently, the brake shoe 74 is brought into frictional engagement with the brake shoe 64 carried by the backing plate 66 fixed to the front frame 15 thereby clamping the clamping plates 38, 46 and 50 of the first, second and third platen units 24, 26 and 28, respectively. In this manner, the first and second and third platen units 24, 26 and 28 are fixedly held in the print position.

After the clamping means 68 has been actuated, the solenoids 104 and 142 of the first and second flying speed control means 108 and 146 are de-energized by a fourth command signal generated by suitable means (not shown). However, the platen means 22 is held in the print position during printing operation by the action of the clamping means 68. It will thus be understood that the actuating means 84 and 86 may employ solenoids 104 and 142 providing minimum driving powers sufficient for merely driving the actuating arms 30 and 40 so as to move the platen means 22 to a point to urge the document A against the guide means 22 and, therefore, the undesirable contamination of the document is avoided even in the case where the document is made of pressure-sensitive papers.

After the printing operation has been completed, the solenoids 80 and 82 of the clamping means 68 are de-energized so that the levers 71 and 72 are rotated counter-clockwise as viewed in FIG. 1 by the actions of the tension springs 76 and 77. Thus, the brake shoe 74 is caused to disengage from the brake shoe 64 and, accordingly, the clamping plates 38, 46 and 50 connected to the first, second and third platen units 24, 26 and 28 are released from the clamping means 68. Since, in this condition, the solenoids 104 and 142 of the first and second actuating means 84 and 128 are held in their de-energized conditions, the bell cranks 86 and 130 are rotated clockwise as viewed in FIG. 1 by the actions of tension springs 120, 122, 152 and 154 so that the platen means 22 are returned to its normal or inoperative position as shown in FIG. 1. If, under this circumstance, the solenoids 186, 192 and 202 of the position selector means 160 are de-energized, the plungers 186*a*, 192*a* and 202*a* of the respective solenoids are caused to protrude by the actions of compression springs 190, 196 and 206. At this instant, the bell crank 162 is rotated clockwise as viewed in FIG. 2 and, thus, the slidable shaft 34 is moved to a position to return the platen means 22 to its normal or initial position.

Figure 7:
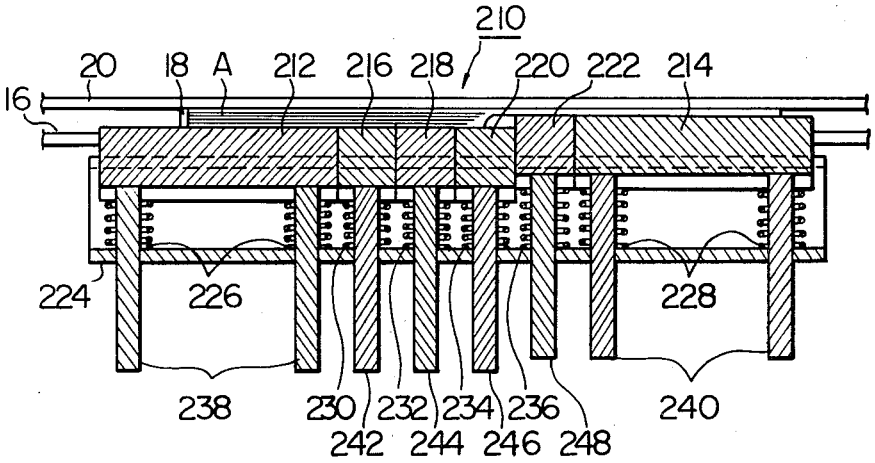
FIG. 7 is a fragmentary cross sectional view of another preferred embodiment of the apparatus according to the present invention.
Figure 8:
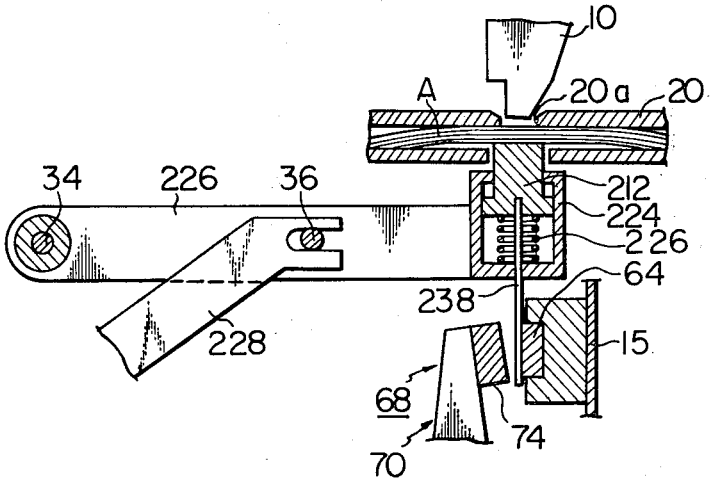
FIG. 8 is a fragmentary left-hand side view, partly in cross section, of the apparatus shown in FIG. 7.

Another embodiment of the print station apparatus according to the present invention is fragmentarily shown in FIGS. 7 and 8 in which like or corresponding component parts are designated by the same reference numerals as those used in FIGS. 1 through 6. In this illustrated embodiment, a platen means generally indicated as 210 comprises first and second platen units 212 and 214, and a third platen unit including a plurality of platen elements 216, 218, 220 and 222. The platen units 212 and 214 and platen elements 216, 218, 220 and 222 are slidably accommodated in a support frame 224 extending in parallel to the print line and normally urged toward the guide means 20 by yieldable urging means such as compression springs 226, 228, 230, 232, 234 and 236 disposed between the bottom wall of the support frame 224 and the lower surfaces of the platen units 212 and 214 and platen elements 216, 218, 220 and 222, respectively. The support frame 224 thus arranged is connected to and moved toward and away from the guide means 20 by actuating arms 226, one of which is shown in FIG. 8. The actuating arms 226 is pivotally supported on the pivot shaft 34 and linked through a bell crank 228 to actuating means (not shown). The first and second platen units 212 and 214 have a pair of clamping plates 238 and 240, respectively. Likewise, the platen elements 216, 218, 220 and 222 of the third platen unit have clamping plates 242, 244, 246 and 248, respectively. The clamping plates 238, 240, 242, 244, 246 and 248 are also slidably guided by the bottom wall of the support frame 224 and extend toward a point between the brake shoes 64 and 74 of the clamping means 68 so that the platen units are fixedly held in the print position during the printing operation. With this arrangement, the first platen unit 212 serves to urge the thick portion of the document A against the guide means 20 and the second platen unit 214 serves to urge the thin portion of the document A against the guide means 20. The platen elements 216, 218, 220 and 222 of the third platen unit are the same in configuration and have length smaller than that of the first platen unit 212 or the second platen unit 214. The platen elements 216, 218, 220 and 222 are arranged to engage with the centerfold of the document A. However, some of these platen elements may engage with the thick or thin portions of the document A as shown in FIG. 7, in which only the platen element 220 engages with the centerfold. It should be understood that since a plurality of platen elements of smaller length are provided along the print line between the first and second platen units, either one of these platen elements may engage with the centerfold of the document even in a case where the distance between the centerfolds of the documents and the guide block 18 varies widely in dependence on the variations in size of the documents to be printed. With this specifically designed platen means 210, a position selector means of the type mentioned hereinabove may be dispensed with, if desired. The apparatus illustrated in this embodiment operates in a manner similar to the first embodiment and, therefore, a detail description of the same is herein omitted for the sake of simplisity of description.

It will now be appreciated from the foregoing description that in accordance with the present invention a recording medium is spaced from a guide means by a predetermined distance proper for operation of the print head and, therefore, it is possible to form imprints of uniform quality in various types of printers. In printers of the type in which the recording media have to be held close to the impact point of the wires, further, it is possible to readily print characters on the recording media even if the recording media is of the kind whose thicknesses vary on either side of the centerfold. Another advantage of the present invention is that the recording surface of the recording media is equally spaced throughout its whole surfaces from the print head even in a case where the thicknesses to either side of the centerfold vary and, therefore, it is also possible to perform printing of characters over the surface near the centerfold of the recording media. It should further be noted that an apparatus of the present invention is arranged to move a platen means toward a guide means with a minimum force whereby the recording media is prevented from being damaged or contaminated. It should also be born in mind that the apparatus of the present invention is simple in construction, easy to manufacture and highly reliable in operation.

While the present invention has been particularly shown and described with reference to preferred embodiment thereof, it will be understood that various changes and modifications may be made without departing from the scope of the invention.

What is claimed is:

1. In a print station apparatus for holding a single sheet or a recording medium having a centerfold for printing of characters thereon by a print head, which apparatus has guide means for spacing the single sheet or the recording medium relative to the print head so that a predetermined amount of spacing is provided between the single sheet or the recording medium and the print head, a platen assembly comprising:

first and second independently movable platen units for holding the single sheet or the recording medium, a third platen unit interposed between the first and second platen units and independently movable relative to the first and second platen units for holding an intermediate portion of the single sheet or the centerfold of the recording medium, the third platen unit including first and second shoulders adapted to engage bottom surfaces of the first and second platen units, respectively, and spring means for yieldingly urging the third platen unit to urge the first and second shoulders of the third platen unit against the first and second platen units, respectively, wherein a continuous planar surface is maintained between all of the platen units when the first and second shoulders engage with the bottom surfaces of the first and second platen units, respectively.

2. In a print station apparatus according to claim 1, in which said spring means comprises first and second springs mounted on said first and second platen units.

* * * * *